US006349418B1

(12) United States Patent
Chiang

(10) Patent No.: US 6,349,418 B1
(45) Date of Patent: Feb. 26, 2002

(54) INNOVATED TYPE OF SWIMMING GOGGLES

(76) Inventor: Herman Chiang, 117-2, No. 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/563,581

(22) Filed: May 3, 2000

(51) Int. Cl.[7] ..... A61F 9/02
(52) U.S. Cl. ..... 2/428; 2/440; 2/445
(58) Field of Search ..... 2/428, 430, 431, 2/439, 440, 441, 447, 445

(56) References Cited

U.S. PATENT DOCUMENTS 2,625,685 A * 1/1953 Moeller ..... 2/428
2,773,260 A * 12/1956 Hirschmann ..... 2/428
3,896,496 A * 7/1975 Leblanc et al. ..... 2/14
4,689,838 A * 9/1987 Angermann et al. ..... 2/441
4,879,770 A * 11/1989 Vacilotto ..... 2/430
4,977,627 A * 12/1990 Metcalfe et al. ..... 2/437
5,564,132 A * 10/1996 Kuo ..... 2/430
5,617,588 A * 4/1997 Canavan et al. ..... 2/428
5,819,321 A * 10/1998 Wang ..... 2/428
6,192,523 B1 * 2/2001 Pan ..... 2/428

* cited by examiner

*Primary Examiner*—John J. Calvert
*Assistant Examiner*—Katherine Moran
(74) *Attorney, Agent, or Firm*—Pro-Techtor International Services

(57) ABSTRACT

The invention relates to an innovated type of swimming goggles, including: a monobloc formation of lens frame main units, nose bridge and protective pad that are made of a flexible material, and two lenses made of a rigid material that are joined by a joint part, wherein in each of the frame openings of the two lens frame main units is an inserted groove, edges are on the rims of the two lenses, and, between the frame openings of the lens frame main units is at least one positioning groove, while on the joint part between the two lenses and opposite to the positioning groove is a stop unit, to enable firmer and more convenient assembling of the two lenses and the lens frame main units. Furthermore, the protective pad has a face mask with the function of single covering space to combine two lens frames as one space, and provide comfortable contact with the user's face.

9 Claims, 11 Drawing Sheets

(A-A)

INNOVATED TYPE OF SWIMMING GOGGLES

FIELD OF THE INVENTION

This invention relates to a type of swimming goggles, particularly the one that is innovated and formed in a monobloc including a main unit of lens frame, a nose bridge and a protective pad, wherein the protective pad serves to combine the two lenses in a same space of frame to provide wearing comfort, while the lenses are assembled firmly with the main unit of lens frame to prevent water seepage.

BACKGROUND OF THE INVENTION

As it is generally known, swimming goggles can be used in swimming pools, for snorkeling or scuba diving. For pool swimmers who need to regulate their breathing above water, swimming goggles must have a nose bridge to facilitate the breathing. For snorkelers or scuba divers who spend much more time in deep water, swimming goggles are made to cover their eyes and nose, to avoid water pressure causing discomfort to the nose. Conventional swimming goggles for pool swimmers have two lens frames pressing on the muscles around the eyes, but the installation of a protective pad may press the muscles around the eyes, the user may feel discomfort, or even water seeping inside due to muscle twitches caused by the discomfort.

OBJECTIVES OF THE INVENTION

The major objective of this invention is to provide a type of swimming goggles exclusively for swimming pool swimmers, involving a protective pad that serves simultaneously as a facemask to provide a comfortable face contact, meanwhile, the two lens frames are combined in one space to enable a unique way of assembling the lenses with the lens frames, and provide convenient and firm assembling effects.

CHARACTERISTICS OF THE INVENTION

The subject invention of innovated swimming goggles is characterized by the fact that: the lens frame main unit, the nose bridge and the protective pad are formed in a monobloc and made of a flexible material, and the said protective pad involves a single covering space; the two lenses made of a rigid material are joined by a joint part, wherein in the frame openings of the lens frame main units are inserted grooves, the edges are on the rim of the two lenses, so that the two lenses can be assembled and fitted into the lens frame main unit.

Another characteristic of the invention of innovated swimming goggles is that, between the frame openings of the lens frame main units is at least one positioning groove, on the joint part between the two lenses and opposite to the positioning groove is a stop unit, so designed that the two lenses and the lens frame main units can be assembled more firmly.

A further characteristic of the invention is that, on the outside of the longer axis of the two lenses is a fixing device used to connect the headband, so that the force when the swimming goggles are worn is resting on the two rigid lenses, to ensure no risk of water seeping through.

Yet another characteristic of the invention lies in that, on the inserted grooves on two sides of the two lens frame main units and near the nose bridge is a reinforcing unit to reinforce the strength of its neighborhood area.

BRIEF DESCRIPTION OF THE DRAWINGS

The invention can be fully understood by reading the following detailed description of the preferred embodiments, with reference made to the accompanying drawings, wherein.

PREFERRED EMBODIMENTS

Figure 1:
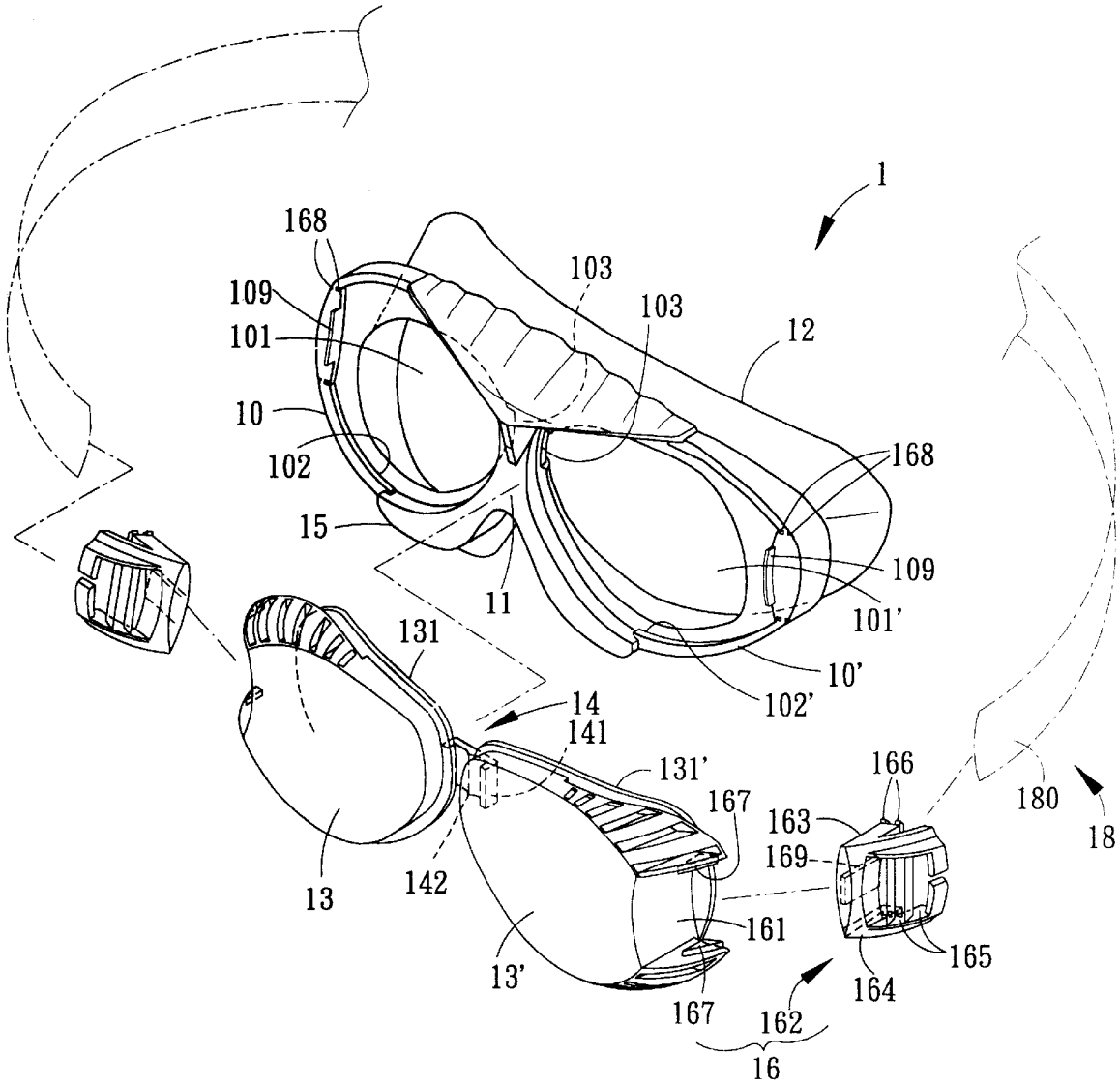
FIG. 1 is a perspective-disassembled view of this invention of innovated swimming goggles.
Figure 3:
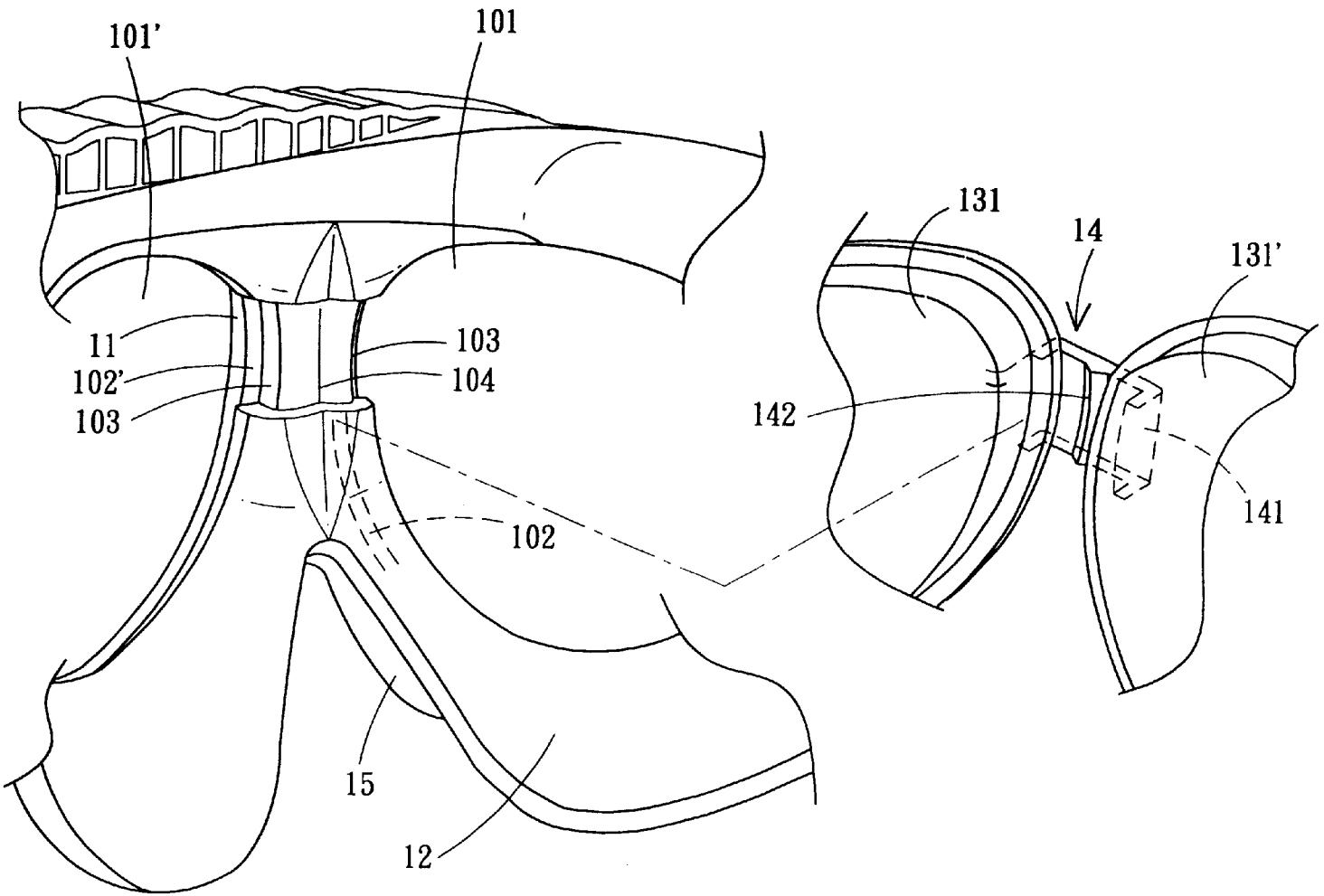
FIG. 3 is a close-up of a part of the lens frame unit in this invention of swimming goggles.
Figure 10:
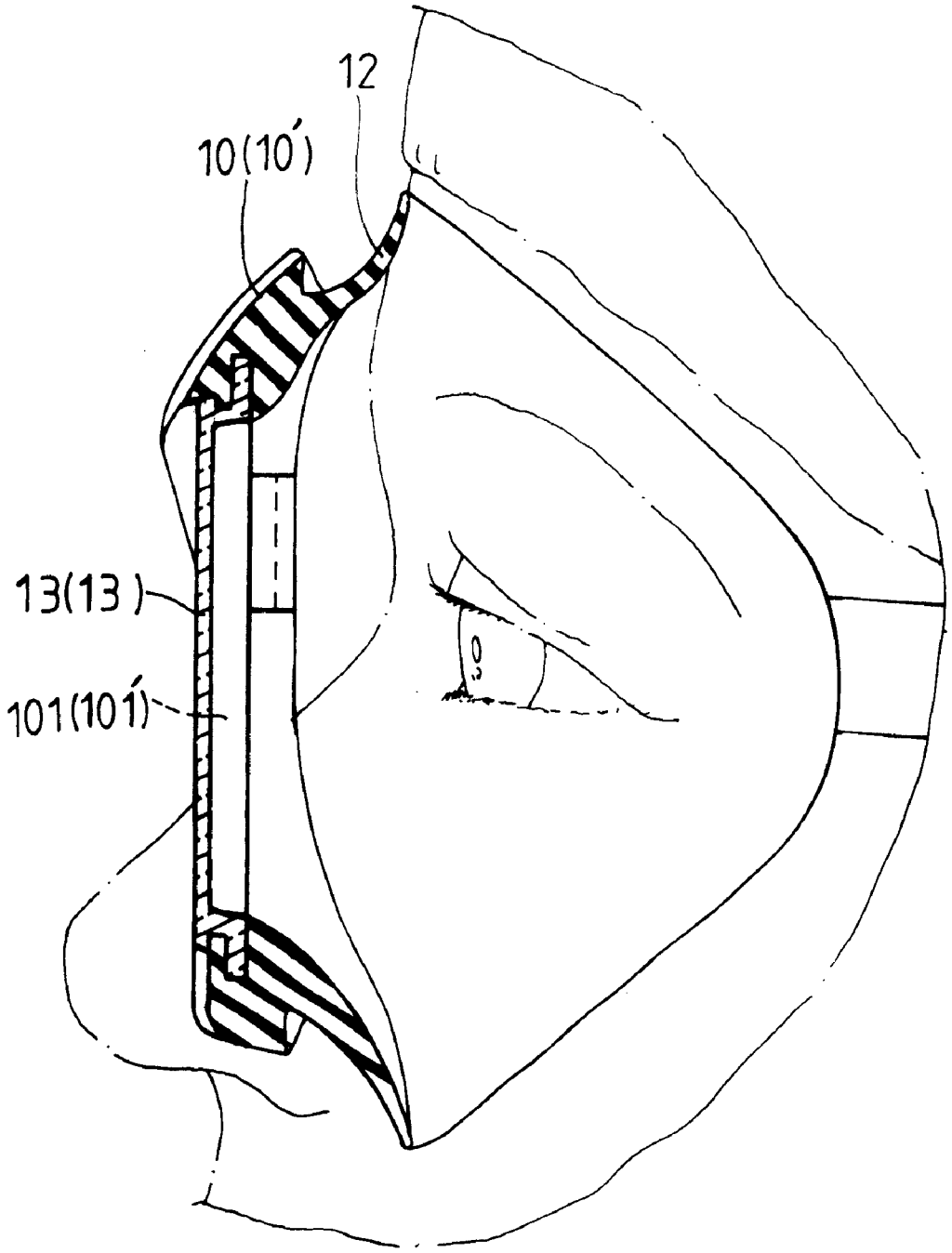
FIG. 10 illustrates how this invention of swimming goggles are worn on a user's face.

Referring to FIG. 1, this invention of swimming goggles 1 includes the following: a main unit formed in a monobloc of two lens frames 10 and 10', a nose bridge 11 and a protective pad that are made of a flexible material, two lenses 13, 13' (to be described later) that are formed in a monobloc and made of a rigid material, a joint part 14 joining the two lens frames 13, 13', and a headband device 18, the said lens frame units 10, 10' have frame openings 101, 101' respectively, and inside the frame openings 101, 101' grooves are inserted 102, 102' in order to position the two lenses 13, 13'. Referring simultaneously to FIG. 3, at the frame openings 101, 101' and near the nose bridge 11 is a first positioning groove 103, the said first positioning groove 103 has a recessed dent formed on the frame openings 101, 101', then between the left and right positioning grooves 103 is a second positioning groove 104 in the shape of a V, where the first and second positioning grooves 103, 104 can be assembled with the joint part 14 in connection with two lenses 13, 13' to solidify the assembly of the whole unit (to be described later). On the frame openings 101, 101' and near the nose bridge 11 is installed a reinforcing unit 15 to intensify the strength of the frame openings 101, 101'. The protective pad 12 extends outwardly from the edge of the frame openings 101, 101' of the main lens frame units 10, 10', creating a height difference from the lens frame main unit and an excellent flexibility, and covering the upper and lower edges of the user's eyes (as shown in FIG. 10) to provide comfortable face contact.

Figure 1A:
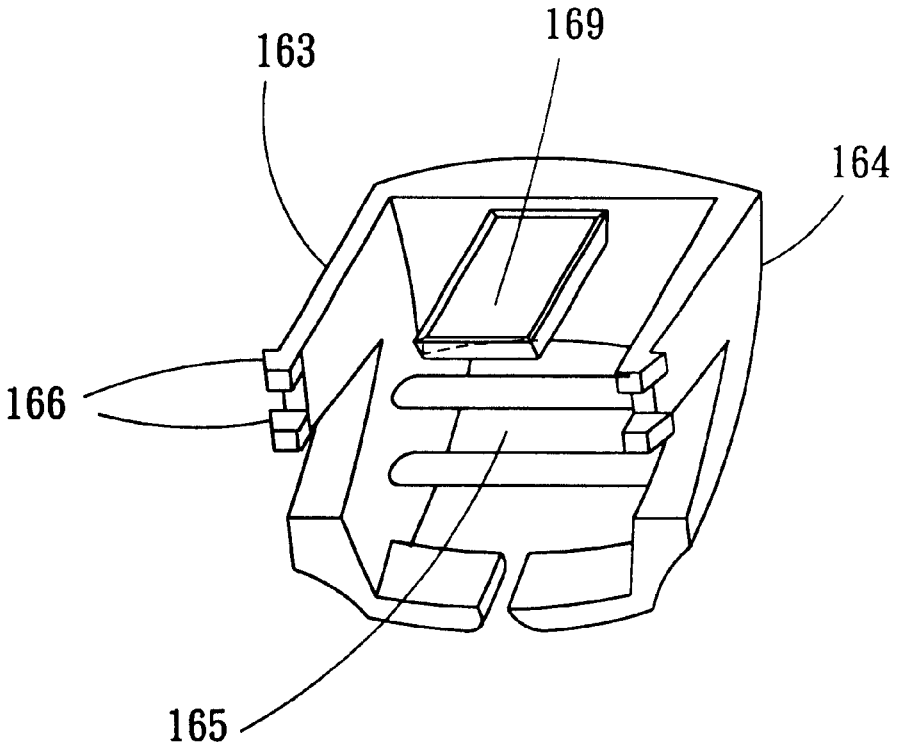
FIG. 1A is a perspective view of a snap piece in the fixing device of this invention of swimming goggles.
Figure 2:
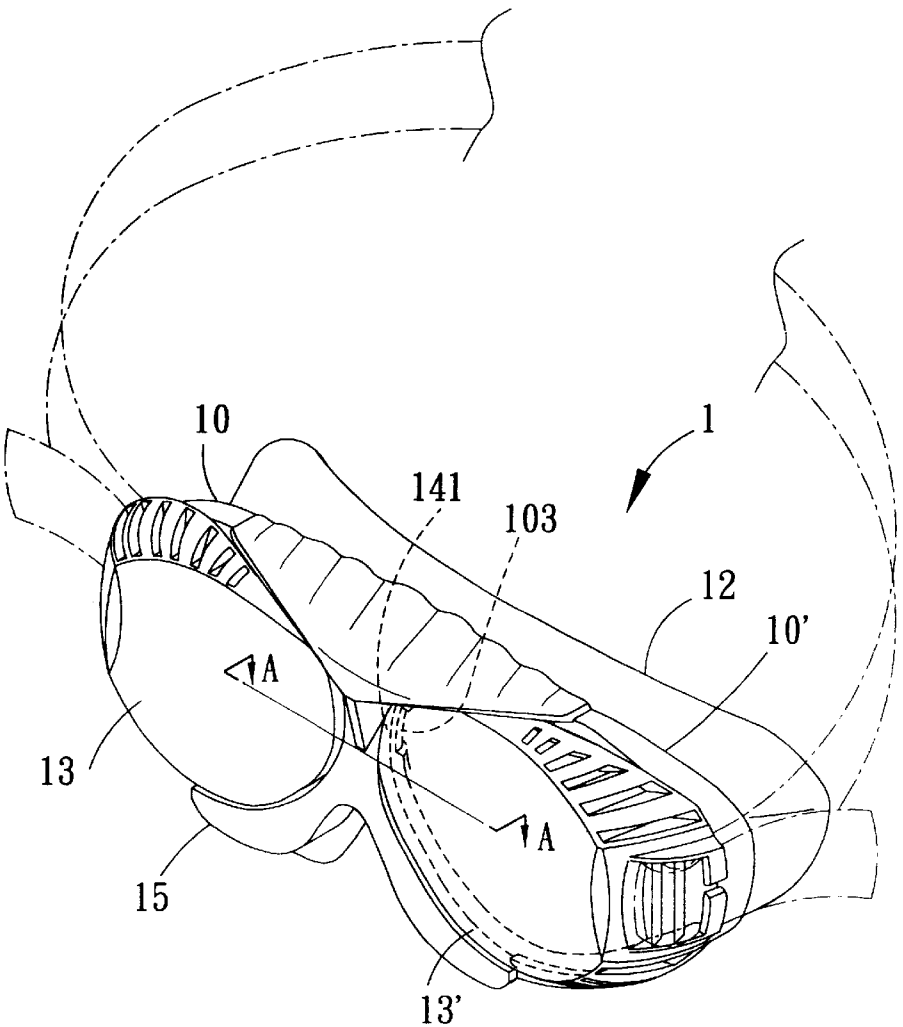
FIG. 2 is a perspective-assembled view of the invention of swimming goggles.
Figure 4:
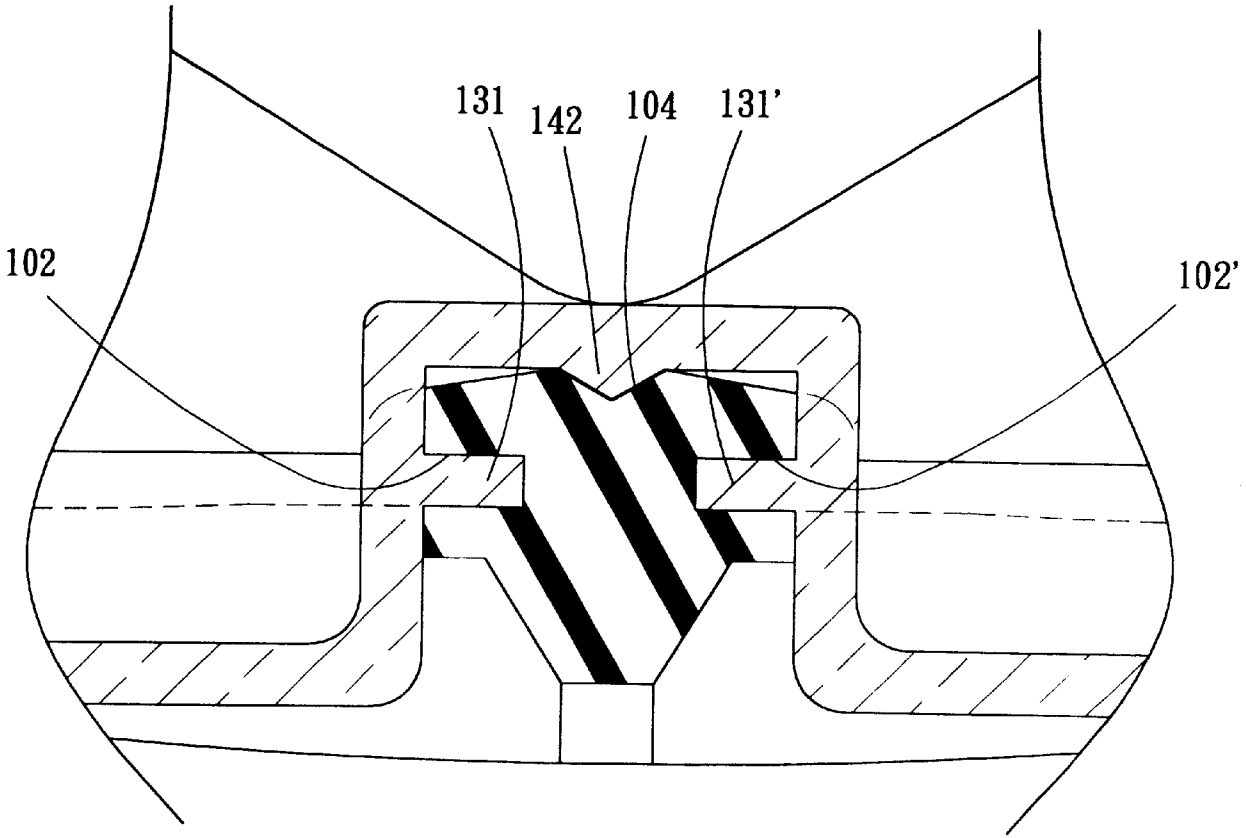
FIG. 4 is a section view of the part marked A—A in FIG. 2.
Figure 5:
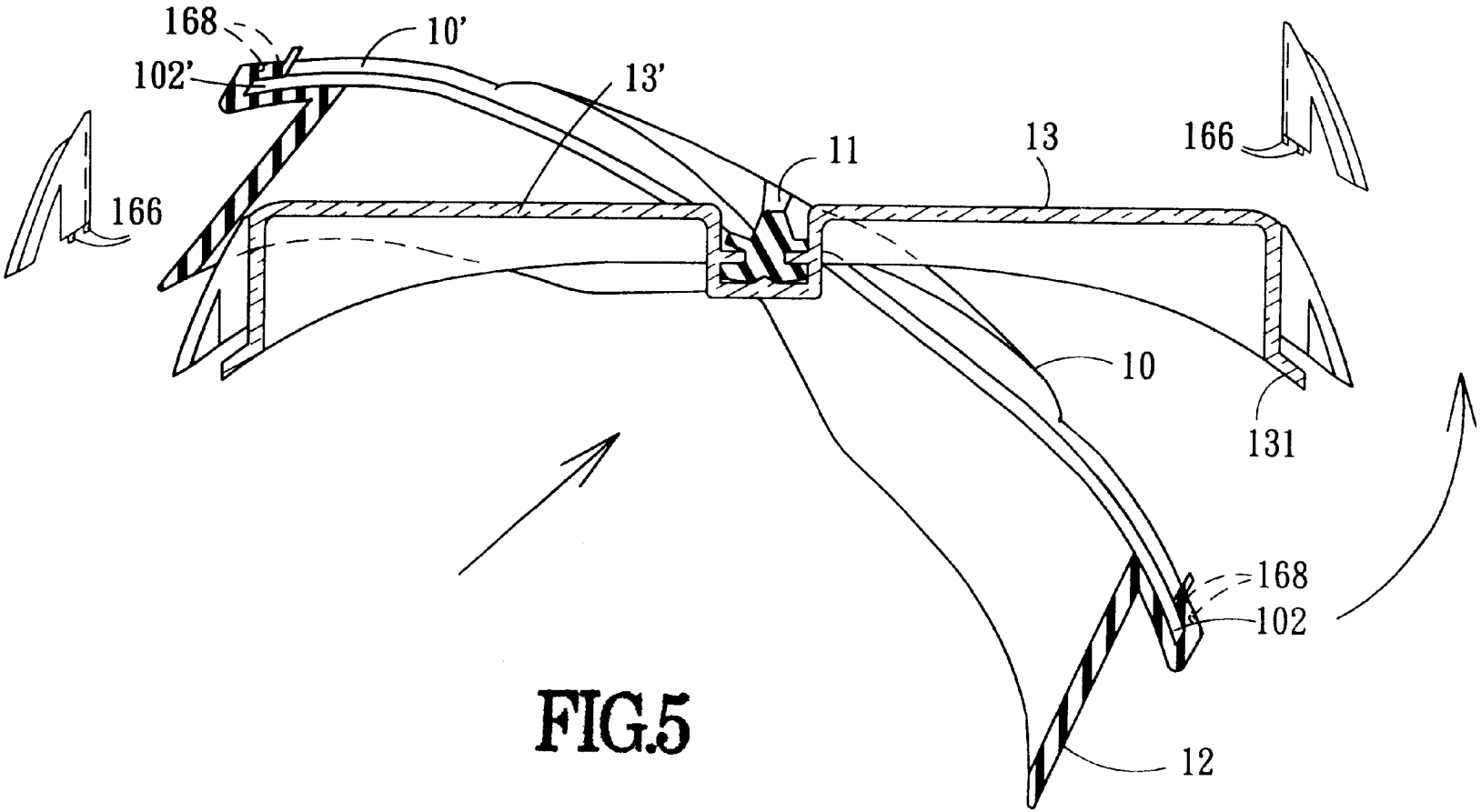
FIGS. 5, 6, 7 and 8 illustrate how this invention of swimming goggles is assembled.
Figure 6:
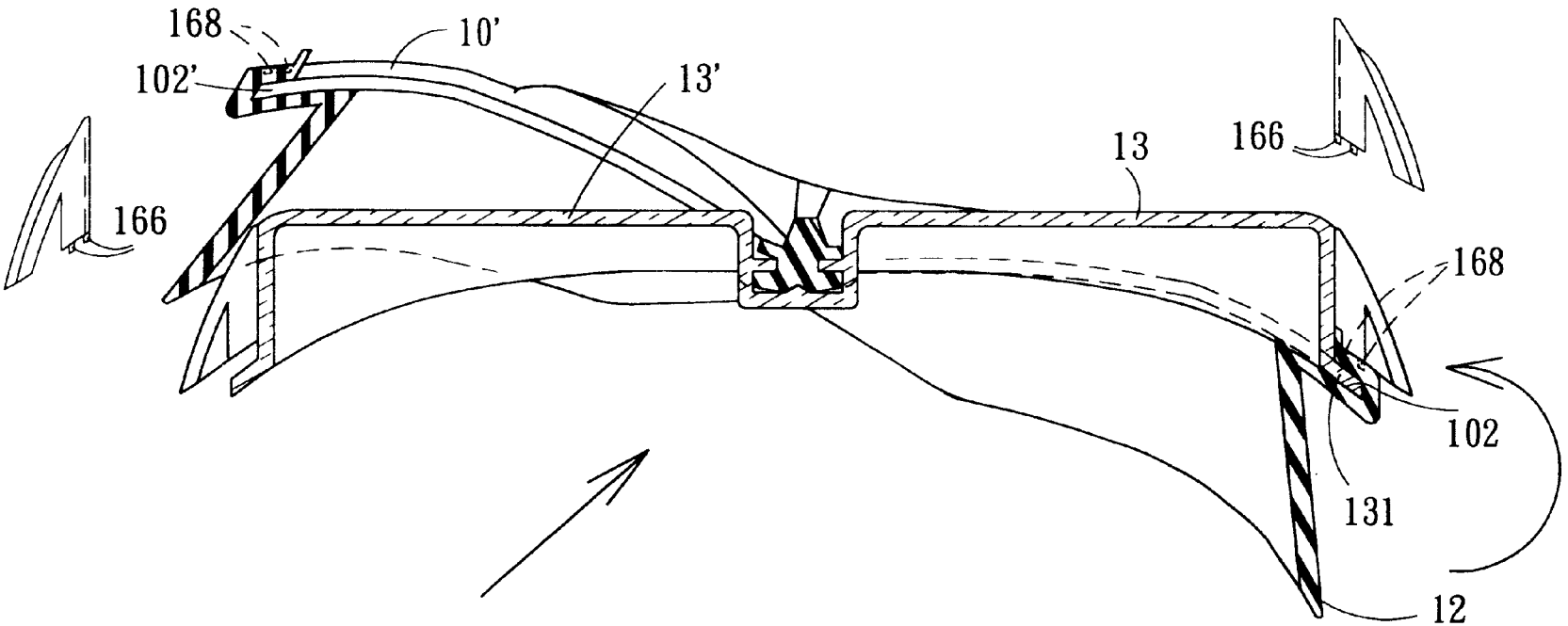
Figure 7:
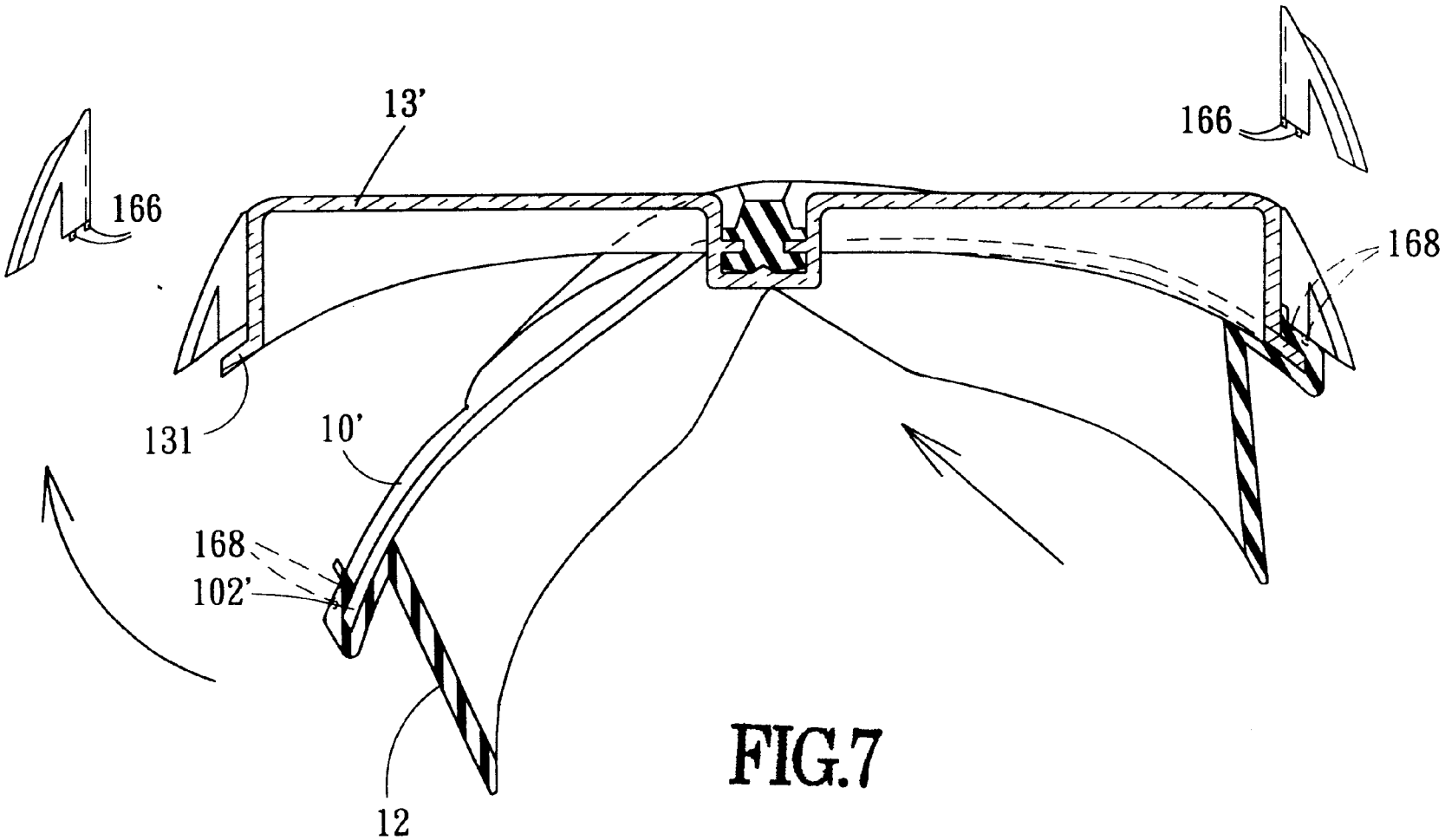
Figure 8:
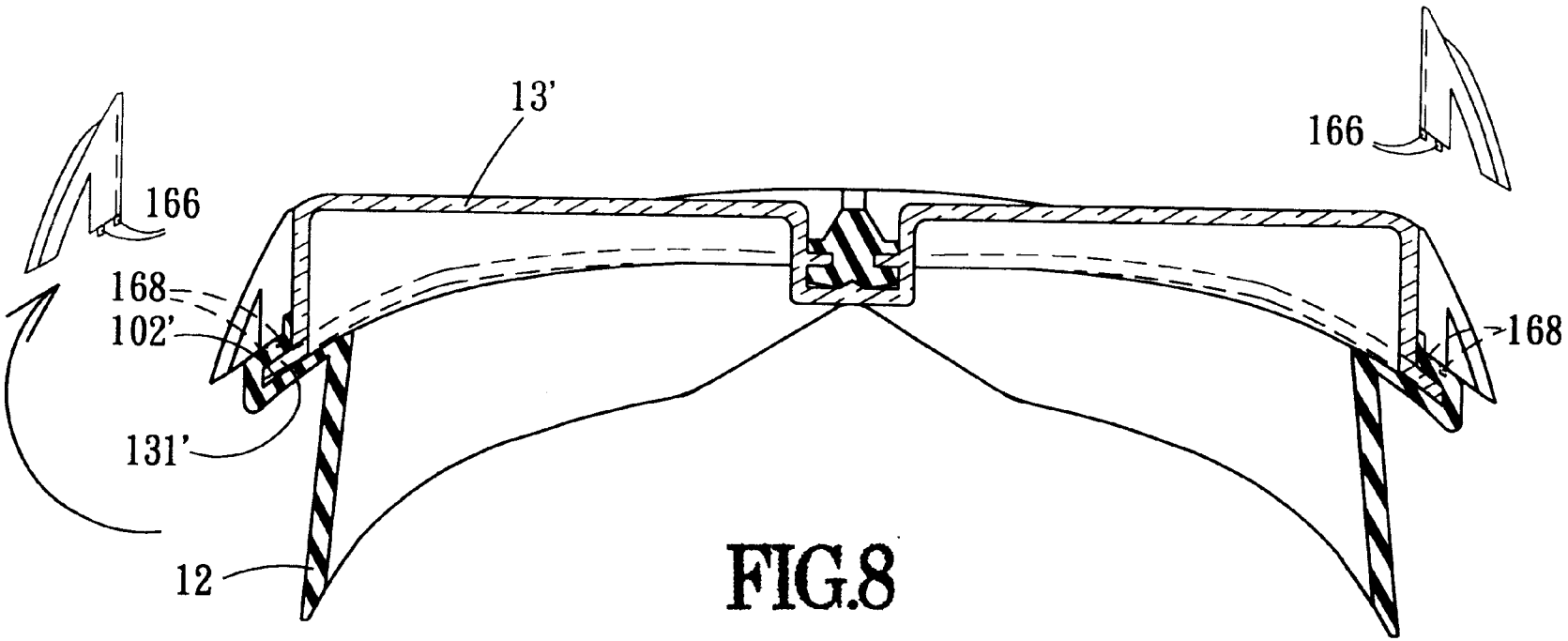
Figure 9:
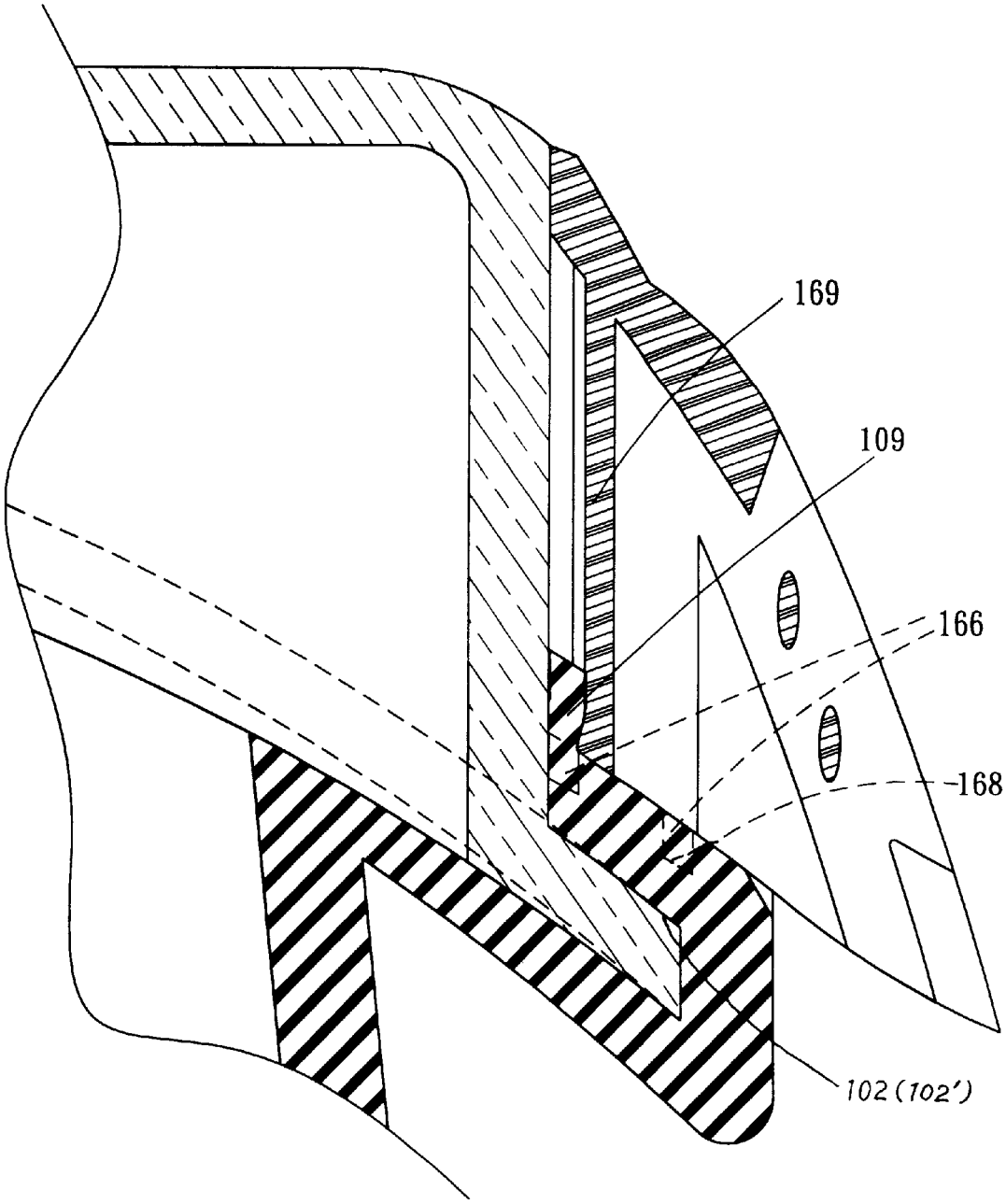
FIG. 9 is a close-up of the fixing device when it is assembled onto the lens frame unit of this invention of swimming goggles.

On the rims of the two lenses 13, 13' are edges 131, 131' that can go into the inserted grooves 102, 102', and on the joint part 14 between the two lenses 13, 13' is a first stop part 141 that can be fitted on the first positioning groove 103 on the frame openings 101, 101'. On the joint part 14 is a V-shaped stop unit 142 that can be fitted on the V-shaped second positioning groove 104. As shown in FIG. 4, it can be understood clearly that the V-shaped stop unit 142 after being assembled, is securely fitted on the V-shaped second positioning groove 104. As shown clearly in FIG. 2, the first stop part 141 is fitted on the dent-shaped first positioning groove 103. Looking back to FIG. 1, on the outside edge of the longer shaft of the two lenses 13, 13' is a fixing device 16, the said fixing device 16 includes: a snap groove 161 on the lenses 13, 13' and a joining plate 162 that can be fitted on the snap groove 161; on the two sides of the joining plate 162 are a combining arm 163 and a leading surface 164, the combining arm 163 has two opposite snap units 166, the said snap units 166 are protruded from the outside of the combining arm 163, so positioned that it can rest on the rear of the bottom of the guide surface 167 on the two sides of the snap groove 161 (not shown in drawing). On the leading surface 164 are several through holes 165 to accommodate the insertion of a headband 180 in the headband device 18. Opposite to the lens frame main unit 10, 10' of the combining unit 166 are snap holes 168, to accommodate the combining unit 166 after the combining arm 163 is assembled, and achieve the function of accommodation and positioning (refer to FIG. 5). Furthermore, as shown in FIG. 1A, between the two combining arms 163 is a stop plate 169 that can push each other against the stop plate 109 on the lens frame main units 10, 10', as shown in FIG. 9, to prevent loosening of the inserted groove 102 (102') on the lens frame main unit 10, 10'; in other words, the stop plate 169 will press against the stop plate 109 after the joining plate 162 is fixed onto the snap groove 161; as a result, the inserted groove 102 (102') will not slip outwardly and escape. Furthermore, the joining plate 162 presses against the rear of the end of the guide surface 167 by means of a snap unit 166 on the combining arm 163 on both sides, meanwhile, the snap unit 166 and the snap holes 168 are fastened in position, to prevent the joining plate 162 from escaping. Please refer to FIGS. 5, 6, 7 and 8, which illustrate how the invention is assembled. To avoid sophistication, the drawings show only the lenses 13, 13' and the lens frame main unit formed in a monobloc 10 and 10', the nose bridge 11 and the protective pad 12, as shown in FIG. 5; to assemble, a section of the twin lenses 13, 13' is pulled out from one side of the protective pad 12, then, as indicated by the arrow, the inserted groove 102 on the lens frame main unit 10 is inserted into the edge 131 of the lens 13 (shown in FIG. 6). Then, the lens frame 10' on the other side is pulled back as in FIG. 7, so that the lens 13' on the other side is located at the front, as indicated by the arrow in FIGS. 7 and 8, the inserted groove 102' is fitted on the edge 131', then the twin lenses 13, 13' can be assembled as one unit with the lens frame main unit formed in a monobloc 10 and 10', the nose bridge 11 and the protective pad 12. One point worth mentioning is that, in addition to the engagement between the aforementioned inserted grooves 102, 102' with the edges 131, 131', by way of further connection between the first stop part 141 on the joining part 14 and the dent-shaped first positioning groove 103 of the frame openings 101, 101', and the connection between the V-shaped stop unit 142 and the V-shaped second positioning groove 104 on the joint part 14 pushing against each other, as shown in FIGS. 2 and 4, the twin lenses 13, 13' and the lens frame main unit formed in monobloc 10 and 10', the nose bridge 11 and the protective pad 12 can be assembled more firmly as one unit. Thus, the aforementioned construction of the invention of swimming goggles will not only provide the user with better comfort and freedom from water leakage, it also provides more convenience and firm assembly.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded to the broadest interpretations so as to encompass all such modifications and similar arrangements.

Brief Description of Numerals 1 swimming goggles
11 nose bridge
18 headband device
101, 101' frame opening
131, 131' edge
104 second positioning groove
14 joint part
142 second stop unit
16 combining device
162 joining plate
164 leading surface
166 snap unit
168 snap holes
18 headband device
10, 10' lens frame main unit
12 protective pad
lenses 13, 13'
102, 102' inserted groove
103 first positioning groove
109 stop plate
141 first stop unit
15 reinforcing unit
161 snap groove
163 combining arm
165 through hole
167 guide surface
169 stop plate
180 headband

What is claimed is:

1. Swimming goggles comprising:

two lenses made of a rigid material, said lenses are connected by a joining part so as to form a single monobloc unit, two lens frame main units, a nose bridge, and a protective pad formed in monobloc and made of a flexible material, each of said lens frame main units comprise frame openings to accommodate lenses, each said frame opening having an insertion groove to accommodate edges of said lens, and said protective pad is extended outward from a rim of said frame opening of said lens frame main unit such that a height difference is created relative to said lens frame main unit, said protective pad covering an upper edge of a user's brow and a lower edge of the user's eye socket to provide comfortable contact with the user's face, and a headband device including at least a headband connected to an outside edge of said two lenses, said edges of said lenses are thus fitted in said insertion grooves in said frame openings of said lens frame main unit to fasten said lenses onto said lens frame main units; wherein in said lens frame main unit near said nose bridge is a dent-shaped first positioning groove, on said joining part of said lenses opposing said first positioning groove is a first stop unit, said first stop unit engaging said dent-shaped first positioning groove.

2. The swimming goggles as recited in claim 1, wherein, the said lens frame main unit and on a nose bridge between said frame openings on one side of the protective pad is a V-shaped second positioning groove, on the joining part of the two lenses and opposite the said second positioning groove is a V-shaped stop unit.

3. The swimming goggles as recited in claim 2, wherein:

on an outer edge of a longer axis of said lenses is a fixing device for connecting a headband, said fixing device includes snap grooves on said lenses and joining plates that are received in said snap grooves, said joining plates having combining arms and leading surfaces; wherein said combining arms are joined with said snap grooves, and on leading surfaces of said joining plates are a plurality of through holes serving to receive said headband and fix said headband in position.

4. The swimming goggles as recited in claim 3, wherein:

each said lens frame main unit comprises reinforcing units extending therefrom at a position near said nose bridge, said reinforcing units reinforcing said frame openings.

5. The swimming goggles as recited in claim 4, wherein:

a snap unit is situated on an outside of an end of each said combining arm of said fixing device, and opposite said snap unit on the lens frame main unit is a joining hole, said joining hole serving to receive said snap unit.

6. The swimming goggles as recited in claim 5, wherein:

between said combining arms of said fixing device is a stop plate, and on the inside of the snap groove of said lens frame main unit, opposite said stop plate, is a blocking plate that contacts said insertion groove on said lens frame main unit.

7. Swimming goggles comprising:

two lenses made of rigid material and joined together by a snapping device, two lens frame main units, a nose bridge, and a protective pad formed in a monobloc and made of a flexible material, each of said lens frame main units have frame openings to accommodate lenses, each said lens frame main unit comprises reinforcing units extending therefrom at a position near said nose bridge, said reinforcing units reinforcing said frame openings, each said frame opening having an insertion groove, and said protective pad covering an upper edge of a user's brow and a lower edge of the user's eye socket to provide comfortable contact with the user's face, and a headband device, including at least a headband connected to outside edges of said lenses, edges of said lenses are inserted in the insertion grooves of said frame openings of said lens frame main unit to fix said lenses onto said lens frame main units.

8. The swimming goggles as recited in claim 7, wherein:

on an outer edge of a longer axis of said lenses is a fixing device for connecting a headband, said fixing device includes snap grooves on said lenses and joining plates that are received in said snap grooves, said joining plates having combining arms and leading surfaces; wherein said combining arms are joined with said snap grooves, and on leading surfaces of said joining plates are a plurality of through holes serving to receive said headband and fix said headband in position.

9. The swimming goggles as recited in claim 8, wherein:

a snap unit is situated on an outside of an end of each said combining arm of said fixing device, and opposite said snap unit on the lens frame main unit is a joining hole, said joining hole serving to receive said snap unit.

* * * * *